US008851571B2

(12) United States Patent
Iulita

(10) Patent No.: US 8,851,571 B2
(45) Date of Patent: Oct. 7, 2014

(54) MOVEMENT DEVICE FOR AN ELEMENT OF FURNITURE

(75) Inventor: Luigi Iulita, Spilimbergo (IT)

(73) Assignee: Stylgame SRL, Spilimbergo (PN) (IT)

( * ) Notice: Subject to any disclaimer, the term of this patent is extended or adjusted under 35 U.S.C. 154(b) by 184 days.

(21) Appl. No.: 13/578,599

(22) PCT Filed: Mar. 15, 2011

(86) PCT No.: PCT/IB2011/051072

§ 371 (c)(1),
(2), (4) Date: Aug. 10, 2012

(87) PCT Pub. No.: WO2011/114286

PCT Pub. Date: Sep. 22, 2011

(65) Prior Publication Data

US 2012/0326479 A1 Dec. 27, 2012

(30) Foreign Application Priority Data

Mar. 17, 2010 (IT) ..... UD2010A0050

(51) Int. Cl.
*A47C 1/00* (2006.01)
*F16M 11/00* (2006.01)
*A47C 3/18* (2006.01)

(52) U.S. Cl.
CPC .. *A47C 3/18* (2013.01); *A47C 3/185* (2013.01)
USPC ..... 297/344.21; 248/406.2

(58) Field of Classification Search
USPC ..... 297/344.21, 344.22, 344.23; 248/406.2
See application file for complete search history.

(56) References Cited

U.S. PATENT DOCUMENTS

| | | | | |
|---|---|---|---|---|
| 2,351,194 | A * | 6/1944 | Herman | 248/417 |
| 3,870,271 | A * | 3/1975 | Bowman | 248/406.2 |
| 4,026,509 | A * | 5/1977 | Wolters | 248/406.2 |
| 4,494,721 | A * | 1/1985 | Trinkel et al. | 248/406.2 |

FOREIGN PATENT DOCUMENTS

| | | |
|---|---|---|
| CH | 321453 | 5/1957 |
| GB | 2430009 | 3/2007 |
| JP | 7222637 | 8/1995 |

* cited by examiner

*Primary Examiner* — Sarah B McPartlin
(74) *Attorney, Agent, or Firm* — Themis Law

(57) ABSTRACT

A movement device for an element of furniture for the movement of a seat includes a rotating shaft, integral with the seat, and a hollow hub integral with the fixed portion. The shaft is coupled in rotatable and axially sliding manner to the hub, to define a first lifted position, in which the seat is positioned with respect to the fixed portion. The device also includes a biasing element coupled to the hub and to the shaft to exert an elastic action of contrast on the shaft and maintain it normally in the first position, a friction element constrained to the shaft, and a stop element integral with the hub and configured to contact selectively the friction element and define a second position of the shaft, which is lowered with respect to the first position and in which the rotation of the shaft is angularly countered by the friction element.

10 Claims, 4 Drawing Sheets

MOVEMENT DEVICE FOR AN ELEMENT OF FURNITURE

FIELD OF APPLICATION

The present invention relates to a movement device for an element of furniture such as a chair, a stool, an armchair or others, which has a seat that can revolve with respect to a fixed portion, such as a pedestal or a supporting element. In particular, the present invention is designed to allow maintaining a preselected position of said seat with respect to the fixed portion in a substantially automatic manner and without any effort by the user.

BACKGROUND ART

Movement devices associated with elements of furniture such as chairs, stools, swivel armchairs, in order to allow the movement of their seat in a preselected position with respect to a fixed portion are known.

Known devices typically comprise a shaft which is fixed to a lower surface of the seat of a chair and a hub which is fixed to a pedestal part of the chair. A lower part of the shaft is connected rotatably to the hub, allowing therefore the rotation of the seat with respect to the pedestal.

Substantially two types of movement devices are known, i. e., a first self-aligning type, which is configured to return the seat automatically to a preset angular position at the end of the use of the chair, and a second freely rotating type, which is shaped in order to allow the free rotation of the seat with respect to the fixed portion without automatic return.

In the first known type of movement device, the shaft is elastically countered by a spring, for example a helical spring, arranged inside the hub. The spring is designed to act between an inner surface of the hub and a surface of an annular rim of the shaft.

These known devices have a cam-like kinematic coupling between the shaft and the hub, so that when the seat, and thus the shaft, is rotated with respect to the preset position, due to the cam-like kinematic coupling, an axial sliding of the shaft with respect to the hub is produced between a preset and aligned position and a lowered position.

This axial sliding occurs so as to compress said spring.

When the seat is released, the spring extends, pushing against the second surface of the shaft, and due to the cam-like kinematic coupling produces the lifting and rotation of the shaft, therefore of the seat, from the lowered position to the preset position, allowing to self-align automatically said seat in its preset position.

With this known device, the spring constantly exerts its elastic thrust against the surface of the shaft, producing a constant torque on the shaft, which affects the seat in a substantially equivalent manner.

Therefore, the user undergoes a rotation, albeit minimal, which is induced by the seat and in order to maintain the preselected angular position has to contrast this rotation by muscular action with his pelvis and lumbar region.

With these known devices there is, moreover, the tendency, due again to the action of the spring, to have uncontrolled and unintentional rotations of the seat during its use.

In the second type of known devices, the rotation of the shaft with respect to the hub, and therefore of the seat with respect to the pedestal, is completely free, allowing uncontrolled and unintentional rotations of the seat during its use, for example due to the inertias generated by the movements of the user's arms.

In this known solution, the user is often forced to counter these rotations with his pelvis and lumbar region in order to return to the preselected angular position.

In both of said known solutions, the muscular contrast that is needed involves, in the long run, a tiring and stiffening of the muscles involved, with consequent aching and discomfort in sitting.

For these reasons, these type of known seats has a limited application, particularly in the case of applications in which is necessary to provide ample comfort to the user, even for long periods of use, such as for example in the field of gaming machines and equipment, work and entertainment stations, or others.

Moreover, chairs provided with the known devices are not adjustable in height by virtue of specific adjustment devices which are independent and separate with respect to the movement device. This entails an increase in the manufacturing costs and functional complexity of installation.

The aim of the present invention is to provide a movement device for an element of furniture, such as a chair, a stool, an armchair or others, that allows to maintain a high stability of the seat during its normal use without requiring the user to perform the necessary and different contrast rotations required to restore or maintain the preselected position.

JP 7 222637 A describes a direction restoring apparatus for a chair with a stopper 52 to limit the downward movement of a shaft rod 5 supporting the chair, the stopper 52 abutting against the external plane surface of a fixed cam member 4 disposed to close the top end of a cylindrical support leg pipe 1 of the chair. Further, according to JP 7 222637 A, a jutting element 6 is disposed on the rod shaft 5 and within the cylindrical support leg pipe 1 to guide the rotational upward movement of the shaft rod 5 against the biasing effect of a spring 3 disposed within the cylindrical support leg pipe 1. The guiding of the rotational upward movement is achieved by the interaction between the jutting element 6 and the lower inclined surface of the fixed cam member 4.

Another object of the present invention is to provide a movement device that also allows adjusting the position of the revolving seat in terms of height.

In order to obviate the drawbacks of the background art and achieve these and further objects and advantages, the Applicant has studied, tested and developed the present invention.

DESCRIPTION OF THE INVENTION

The present invention is expressed and characterized in the independent claim.

The dependent claims illustrate other characteristics of the present invention or variations of the main solution idea.

In accordance with said aim and objects, a movement device for an element of furniture such as a chair, a stool, an armchair or others, according to the present invention, can be used to allow the angular movement of a revolving seat of the element of furniture, with respect to a fixed portion, such as a pedestal, a supporting base or others.

The movement device comprises a rotating shaft, designed for the rotation of the seat and integral with the seat itself, and a hollow hub, which is integral with the fixed portion.

The shaft is coupled so that it can rotate and slide axially with respect to the hollow hub, so as to define at least one first lifted rest position, in which the seat is positioned in a free or predefined determined position with respect to the fixed portion.

In a variation, the device according to the present invention comprises, moreover, a cam element which is integral with the hollow hub, is substantially coaxial with respect to the rotating shaft and is configured so as to define at least an upper or top portion.

In this variation, the device furthermore comprises sliding means which are integral with the rotating shaft and are designed to cooperate with the upper portion of the cam element when the rotating shaft is in said rest position.

The movement device comprises, moreover, elastic means coupled both to the hollow hub and to the rotating shaft.

Said elastic means are adapted to exert an axial elastic contrast action on the rotating shaft when it is moved from its first rest position.

This axial elastic contrast action determines, when the seat is released, the axial thrust on the shaft toward its first rest position.

In a different solution, in which the movement device provides for an automatic alignment of the seat in a predefined position, the shape of the cam, together with the thrust action of the spring, also gives the rotating shaft a rotary movement, with respect to the fixed portion, until the seat aligns in the predefined position.

According to a characteristic aspect of the present invention, the device comprises friction means constrained to the rotating shaft and a stop element, which is integral with the hollow hub and configured so as to contact selectively the friction means, in order to define a second position of use of the rotating shaft, lowered with respect to the first rest position, in which the rotation of the rotating shaft, and thus of the seat, is angularly countered due to the friction means.

In this manner, in a lowered condition of the rotating shaft, i. e., when the user is sitting on the seat and overcomes with his weight the force of the elastic means, the friction means are maintained pressed against the stop element and exert an action of torsional contrast against the free rotation of the seat, allowing the user to have greater control over the rotation of the seat and to maintain the preselected angular position.

With the present invention, therefore, the movement device, besides allowing an efficient rotation action, or possibly a self-alignment, of the seat when the rotating shaft is in its first rest position (i. e., when the user does not use the seat), counters any uncontrolled or unintended rotations of the seat when the rotating shaft is in the second position of use (i. e., when the user uses the seat), by virtue of the effect of the friction means.

Therefore, when the user is sitting on the seat and chooses at will a determined angular position of the latter, for his better comfort, this angular position is substantially maintained without effort for the user, because the friction means counter any rotational inertias generated by the movements of said user, allowing however an intentional rotation of the seat in order to vary in a selective manner its angular position.

The same friction means, once the seat has been released, thus allowing the elastic means to return the rotating shaft to its first rest position, do not prevent or counter in any manner the rotation of the shaft and therefore the sliding of the sliding means with respect to the cam element.

In fact, the friction means, once they have dissociated from the stop element, lose their effectiveness as a contrast to rotation, allowing the rotating shaft to rotate freely with respect to the hollow hub.

According to a variation, the friction means comprise a plurality of discs arranged in contact and coaxially both to each other and to the rotating shaft.

At least one first disc is integral with the rotating shaft, so as to move together with it, and at least one second disc is made of a friction material, in order to define a desired condition of friction with the first disc, at least when the rotating shaft is in the second position of use.

Advantageously, the friction means comprise a third disc, which is arranged in contact with the second disc, on the opposite side with respect to the first disc, and is adapted to contact the stop element in the second position of use of the rotating shaft.

According to this variation, the three discs form substantially a pack of discs which are mutually in contact and which, in the second position of use, and thus in a position of contact with the stop element, are maintained in mutual contact under pressure by the thrust of the rotating shaft on the first disc and by the reaction generated by the stop element on the third disc.

In this pressure condition, a rotation of the rotating shaft, and thus of the first disc, generates a relative rotary motion among the three discs with different speeds, augmenting the friction effect, and thus the rotation contrast effect, determined by the second disc. Basically, the third disc remains substantially motionless.

According to a variation, the elastic means act against the friction means, and particularly against the third disc, so as to be associated with the rotating shaft and determine the elastic thrust on said rotating shaft.

According to another variation, the device comprises, moreover, rolling means, for example an axial bearing, which is arranged coaxially to the rotating shaft and is interposed between the elastic means and the hollow hub, so as to discharge any torsional tensions of the elastic means generated by the rotation of the rotating shaft and of the friction means.

In a different solution, the elastic means comprise a helical spring whose ends are designed to be positioned on one side against the friction means, i. e., against the third disc, and on the other side against the rolling means.

According to another variation, in which the device has a self-alignment function when the seat is not in use, the cam element comprises a shaped annular surface defined inside the hollow hub in a coaxial position with respect to the rotating shaft.

The sliding means comprise at least one cam follower wheel, which is rotatably mounted and protrudes radially from the rotating shaft and is designed to roll along the shaped annular surface.

The mutual position between the annular surface and the cam follower wheel is such that the latter contacts the annular surface, thus affecting the rotation of the rotating shaft, substantially only when the rotating shaft is in its first rest position, and in some intermediate positions, which are in any case close to the rest position.

In the position of use, and in intermediate positions close to the position of use, the cam follower wheel is separated from the annular surface, without thus affecting the rotation of the rotating shaft.

In this manner, therefore, the rotary motion is disconnected from the axial motion of the shaft and so is the action of the elastic means on any rotation of the rotating shaft, in order to return the seat to the preset position.

According to another variation, the rotating shaft comprises a tubular sleeve with which the friction means and the sliding means are associated externally, and a threaded adjustment stem, which is adapted to be screwed into an axial through cavity of the tubular sleeve.

The seat is associated in a downward region with the upper end of the threaded stem, so that a selective screwing/unscrewing of the stem with respect to the sleeve causes a corresponding lowering/lifting of the seat with respect to the fixed portion.

Advantageously, the device comprises an arrest element, for example of the screw type, designed to act radially on the stem and temporarily prevent its rotation with respect to the sleeve in order to constrain the mutual position between said stem and said sleeve.

In this manner, a device for adjusting the installation height is also substantially integrated with the movement device.

This advantageous solution allows reducing further the manufacturing costs and times of the device and generally of the element of furniture to which it is applied, and also facilitates the operations for intervention and installation.

DESCRIPTION OF THE DRAWINGS

These and other characteristics of the present invention will become apparent from the following description of a preferred embodiment, given by way of non-limiting example with reference to the accompanying drawings, wherein.

DESCRIPTION OF A PREFERRED EMBODIMENT

With reference to the accompanying figures, a movement device 10 according to the present invention is applied to a chair 12, in the specific case, in order to allow, in a substantially automatic manner, both the alignment of a seat 13 thereof in a preset position with respect to a fixed portion, in the specific case a pedestal 15 thereof, and the maintaining of a preselected position of the seat 13 with respect to the pedestal 15.

Figure 1:
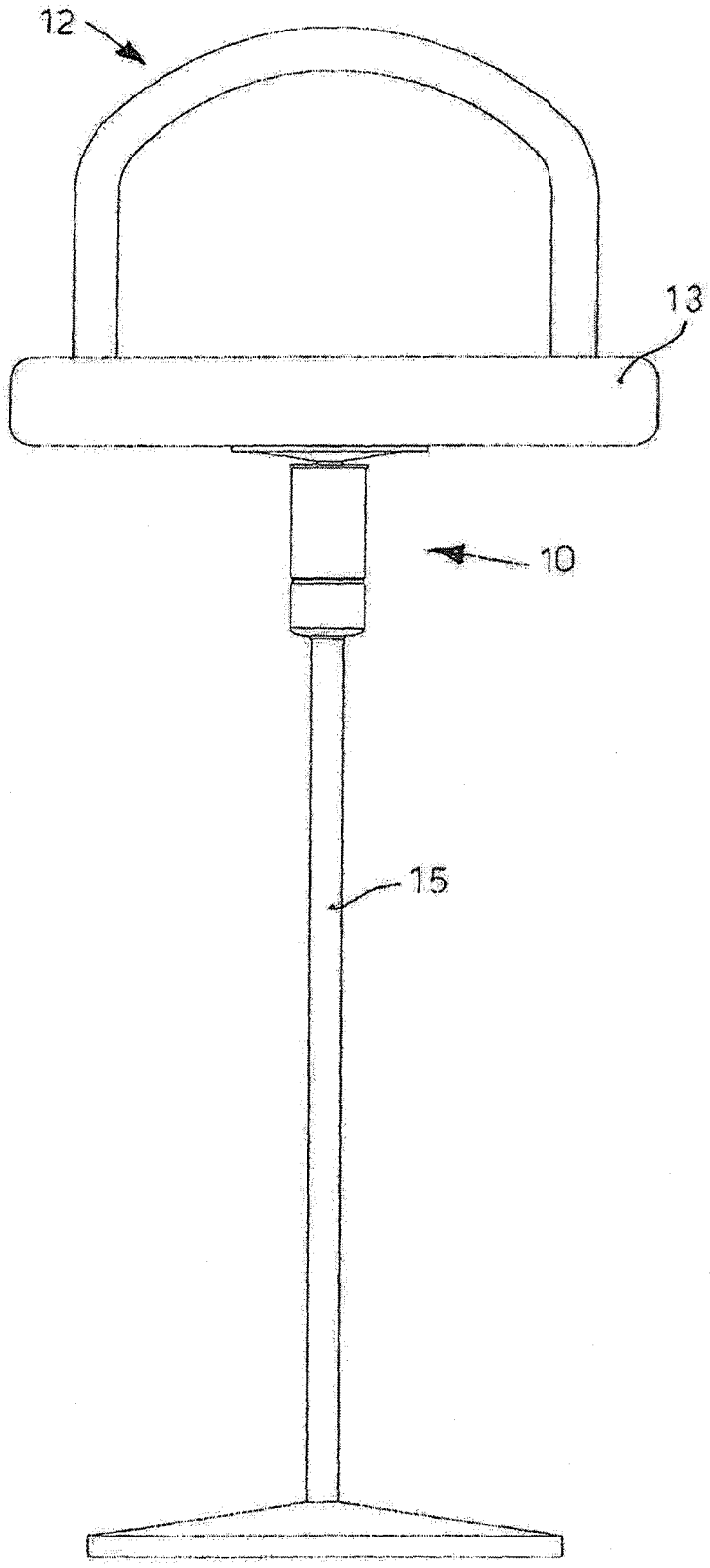
FIG. 1 is a schematic view of an element of furniture on which a self-aligning device according to the present invention is installed.

In FIG. 1, the seat 13 of the chair 12 is shown arranged in its preset position.

Figure 2:
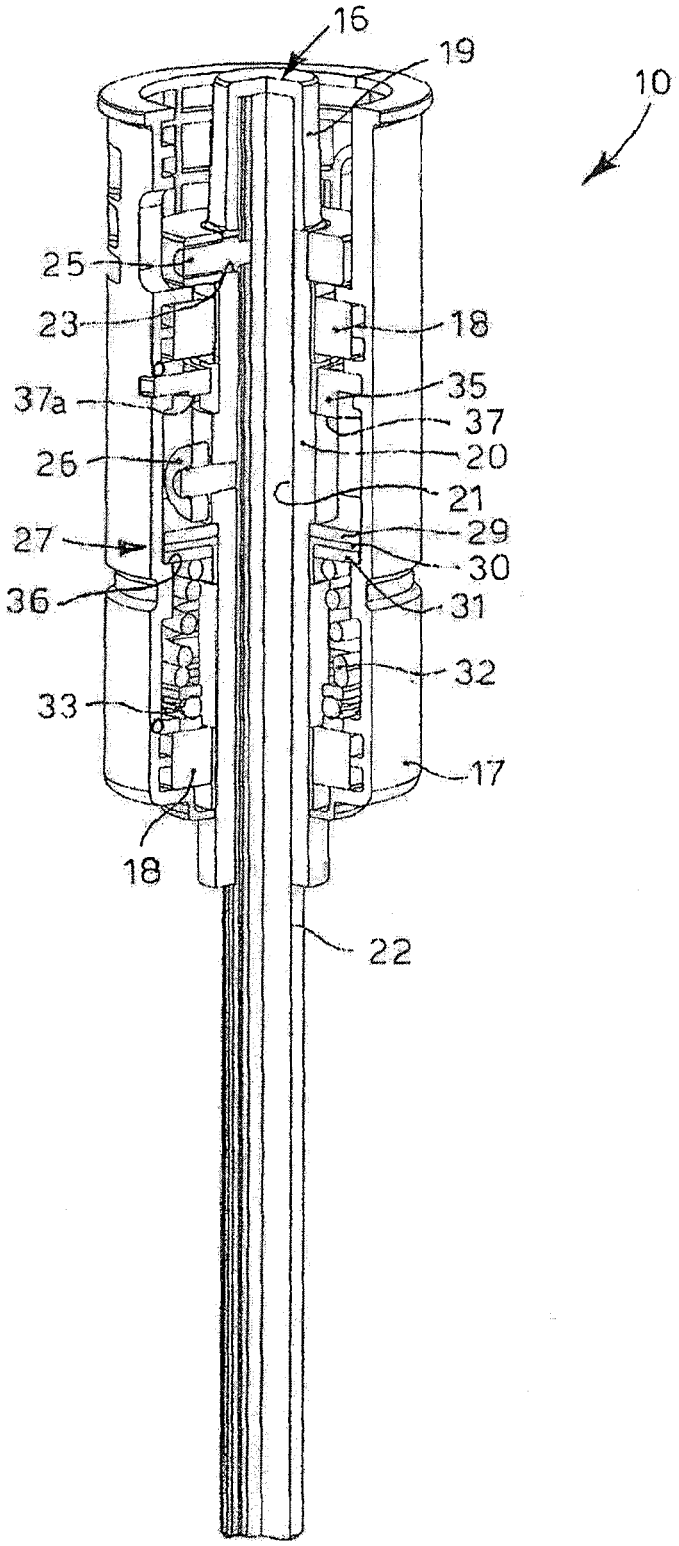
FIG. 2 is an axonometric and partially sectional view of a self-aligning device according to the present invention.
Figure 3:
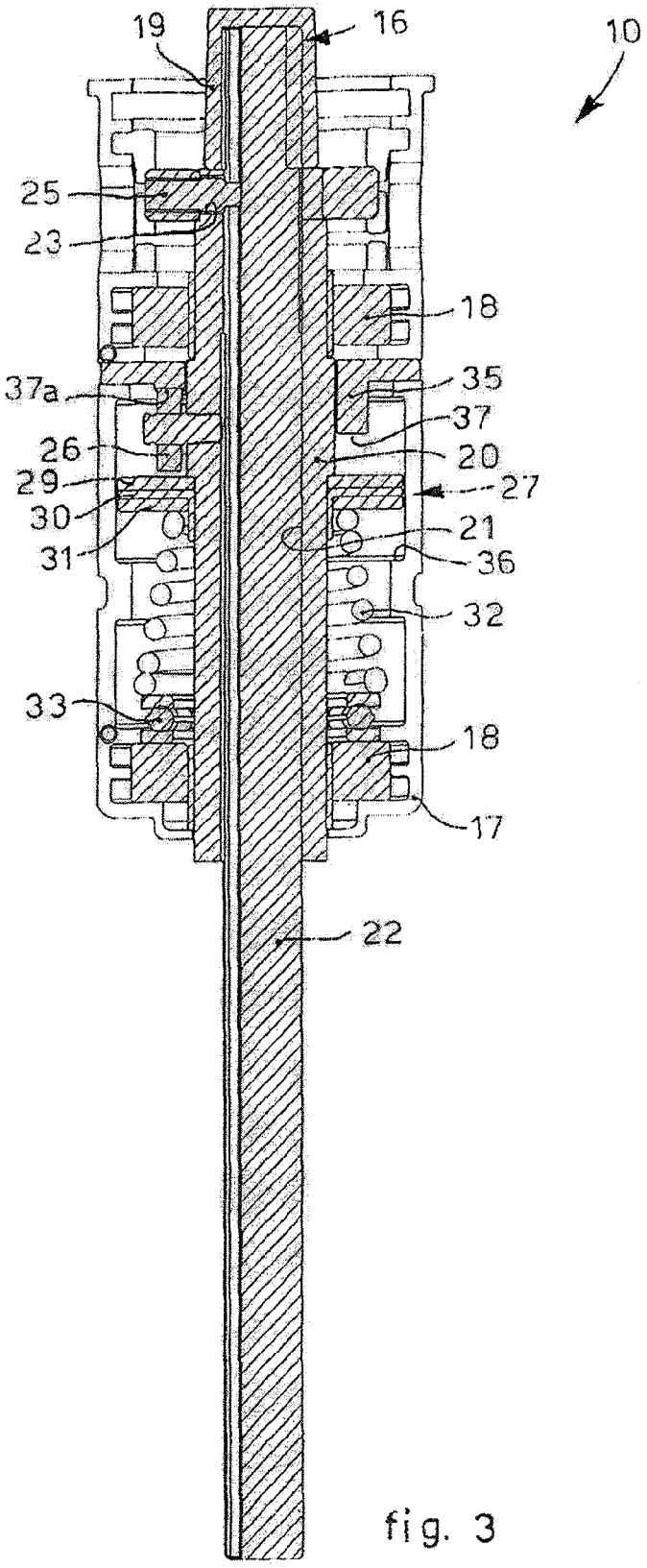
FIG. 3 is a transverse sectional view of the device of FIG. 2 in a first rest condition.
Figure 4:
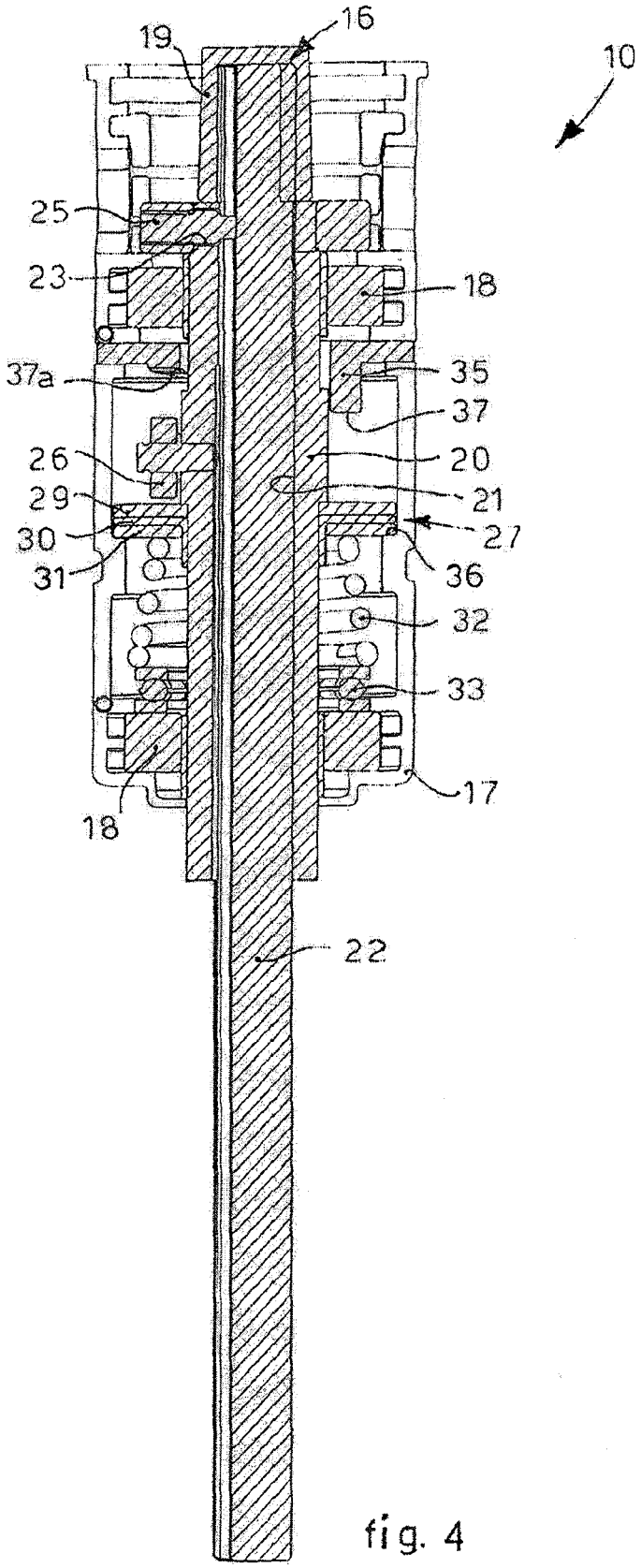
FIG. 4 is a transverse sectional view of the device in FIG. 2 in a second condition of use.

The device 10 (FIGS. 2, 3 and 4) comprises a rotating shaft 16, which is integral with the seat 13, and a hollow hub 17, which is integral with the pedestal 15.

The rotating shaft 16, made for example of steel, comprises at a first end a conical shank 19 designed to be fixed to the seat 13 and is coupled so as it can rotate and slide axially to the hub 17. The coupling between the rotating shaft 16 and the hub 17 occurs, in this case, by virtue of two bearings 18, two bushes or other appropriate rotating elements.

The device 10 comprises, moreover, a helical spring 32 arranged inside the hub 17 in a coaxial position with respect to the rotating shaft 16, so as to act elastically on said rotating shaft 16 and normally keep it in a lifted rest position, in which the automatic alignment of the seat 13 occurs with respect to the pedestal 15.

In the specific case, the shaft 16 comprises a substantially tubular sleeve 20, which is provided axially with a threaded cavity 21, and a threaded adjustment stem 22 screwed inside the threaded cavity 21 of the sleeve 20.

In this manner, the selective screwing/unscrewing of the threaded stem 22 with respect to the sleeve 20 causes the lowering/lifting of the seat 13 with respect to the pedestal 15, at least for an initial adjustment of mutual positioning.

In the case being considered, the sleeve 20 comprises a threaded radial through hole 23, which opens onto the threaded stem 22 and allows the screwing therein of an arrest screw 25, which by contacting radially with pressure the threaded stem 22 inhibits its accidental rotation.

In this manner, the adjustment and the mutual positioning set between the seat 13 and the pedestal 15 is thus ensured.

A cam follower wheel 26 is rotatably mounted on the sleeve 20 so as to protrude radially from it; its functionalities will be explained in detail hereinafter.

A friction element 27 is associated with the external surface of the sleeve 20 and in the specific case is composed of a first disc 29, a second disc 30 and a third disc 31.

The three discs 29, 30 and 31 are arranged in mutual contact in a packed condition and are substantially coaxial to the rotating shaft 16. The outside diameter of each disc 29, 30 and 31 is smaller than the inside diameter of the hub 17, so as to be able to slide freely inside it.

In particular, the first disc 29 is made of metal and is integral, for example by interference, with the external surface of the sleeve 20, so as to follow the axial and rotary movements of the rotating shaft 16 with respect to the hollow hub 17.

The second disc 30 is made of friction material, such as for example Ferodo®, felt or others, and is free with respect to the rotating shaft 16. Its axial movement and its rotation are induced by the movements of the first disc 29.

The second disc 30 defines a chosen rotation friction between itself and the first disc 29.

According to a variation, the surface of contact between the second disc 30 and the first disc 29 is knurled or in any case provided with other surface irregularities that allow increasing at will the rotary friction between the two discs 29 and 30.

The third disc is made of metal and is free with respect to the shaft 19. The helical spring 32 is adapted to act on the third disc 31 in order to actuate said elastic thrust on the rotating shaft 16.

In particular, the helical spring 32 is arranged, on one side, in contact with the third disc 31 of the friction element 27 and rests on the other side against a bottom surface of the hub 17 by virtue of an axial bearing 33 or thrust bearing.

This arrangement of the helical spring 32 on the axial bearing 33 allows to discharge any torsional tensions of said helical spring 32, which can develop due to the rotation of the rotating shaft 16 and be transmitted in an induced manner by the third disc 31.

A cam 35 and an abutment profile 36 are formed inside the hub 17, starting from the top.

The cam 35 comprises a shaped annular surface 37 which is formed coaxially to the rotating shaft 16 and faces downward, i. e., toward the cam follower wheel 26. The annular surface 37 comprises an upper portion 37*a*, in which the cam follower wheel 26 is arranged, when the rotating shaft is in the first rest position.

The cam follower wheel 26 is adapted to slide along the annular surface 37 and is maintained in contact therewith due to the elastic thrust imparted by the helical spring 32 to the rotating shaft 16.

The annular surface 37 has a specific shape, such as to intentionally affect a combined axial and rotary motion of the rotating shaft 16, when the cam follower wheel 26 is kept functionally in contact with the annular surface 37.

The annular surface 37 of the cam 35, according to some variations, may have such a configuration to allow a rotation through 360°, i. e., through 90° to the right and through 90° to the left, or other configurations chosen as a function of the different applications of the chair 12.

If the pressure applied to the rotating shaft 16 is greater than the elastic thrust of the spring 32, the cam follower wheel 26 may detach from the annular surface 37, disengaging the combined axial and rotary motion of the rotating shaft 16.

The abutment profile 36 protrudes radially toward the inside of the hub 17 and is provided at such a height as to define a second position of use of the rotating shaft 16.

In this second position of use of the rotating shaft 16 the cam follower wheel 26 is completely detached from the annular surface 37 and the helical spring 32 is compressed axially.

When the rotating shaft 16 is moved axially by the weight of the user who is sitting on the seat 13, the third disc 31 of the friction element 27 contacts with an outer circular external portion the abutment profile 36, resting on it.

Due to the packed condition of the three discs 29, 30 and 31 and to the fact that the first disc 29 is integral with the sleeve 20, the resting of the third disc 31 on the abutment profile prevents a further axial movement of the rotating shaft 16.

In this condition, the first disc 29 maintains under pressure the other two discs 30 and 31, increasing the conditions of friction defined by the second disc 30. Therefore, any rotation of the rotating shaft 16, and thus of the first disc 29, is countered by the friction defined by the second disc 30.

It is evident that the device 10 described so far can be subject to modifications and/or additions of parts without thereby abandoning the scope of the present invention.

It is also evident that although the present invention has been described with reference to specific examples, a person skilled in the art can certainly provide many other equivalent embodiments of a movement device for an element of furniture having the characteristics expressed in the claims and therefore all within the protective scope defined thereby.

The invention claimed is:

1. A movement device for an element of furniture, usable to allow angular movement of a revolving seat of said element of furniture with respect to a fixed portion, said device comprising:

a rotating shaft, integral with said revolving seat;

a hollow hub, integral with said fixed portion, wherein said rotating shaft is coupled in a rotatable and axially sliding manner to said hollow hub to define at least a first, lifted, position of rest, in which a positioning of said seat takes place in a free, or predefined, determined position with respect to said fixed portion;

a biasing element, coupled both to said hollow hub and to said rotating shaft, to exert an axial elastic action of contrast on said rotating shaft and to maintain said rotating shaft normally in said first position of rest; a friction element, constrained to said rotating shaft and disposed within said hollow hub;

a stop element, integral with said hollow hub and configured to selectively contact said friction element to define a second position of use of said rotating shaft, lowered with respect to said first position of rest, in which rotation of said rotating shaft is angularly countered by said friction element; and a rolling element, arranged coaxially to the rotating shaft and interposed between the biasing element and the hollow hub to release torsional stresses of the biasing element.

2. The device as in claim 1, wherein the friction element comprises a plurality of discs arranged in contact, and coaxially, both to each other and to the rotating shaft.

3. The device as in claim 2, wherein the friction element comprises at least a first disc arranged to be integral with the rotating shaft, so as to move together with the rotating shaft, and at least a second disc comprising a friction material and configured to define a desired condition of friction with said first disc, at least in the second position of use of said rotating shaft.

4. The device as in claim 3, wherein the friction element comprises a third disc arranged in contact with the second disc, from a side opposite the first disc, and configured to contact the stop element in the second position of use of the rotating shaft.

5. The device as in claim 1, wherein the biasing element acts against the friction element so as to be associated to the rotating shaft and to provide an elastic thrust on said rotating shaft.

6. The device as in claim 1, wherein the biasing element comprises a helical spring.

7. A movement device for an element of furniture, usable to allow angular movement of a revolving seat of said element of furniture with respect to a fixed portion, said device comprising:

a rotating shaft, integral with said revolving seat;

a hollow hub, integral with said fixed portion, wherein said rotating shaft is coupled in a rotatable and axially sliding manner to said hollow hub to define at least a first, lifted, position of rest, in which a positioning of said seat takes place in a free, or predefined, determined position with respect to said fixed portion;

a biasing element, coupled both to said hollow hub and to said rotating shaft, to exert an axial elastic action of contrast on said rotating shaft and to maintain said rotating shaft normally in said first position of rest; a friction element, constrained to said rotating shaft and disposed within said hollow hub; a stop element, integral with said hollow hub and configured to selectively contact said friction element to define a second position of use of said rotating shaft, lowered with respect to said first position of rest, in which rotation of said rotating shaft is angularly countered by said friction element;

a cam element, integral with said hollow hub, substantially coaxial to said rotating shaft and having at least an upper portion; and a sliding element, integral with said rotating shaft and configured to cooperate with said upper portion of said cam element, to define said first position of rest of said rotating shaft, wherein the cam element comprises an annular surface shaped to define at least the upper portion and disposed inside the hollow hub in a coaxial position with respect to the rotating shaft.

8. The device as in claim 7, wherein the sliding element comprises at least a cam follower wheel, rotatably mounted and radially protruding from the rotating shaft, and designed to roll along the annular surface of the cam element.

9. The device as in claim 7, wherein the rotating shaft comprises a tubular sleeve, to which the friction element and the sliding element are associated outwardly, and a threaded adjusting stem, which is configured to be selectively screwed into an axial through cavity of said tubular sleeve.

10. The device as in claim 9, further comprising an arrest element designed to radially act on the adjusting stem and to temporarily prevent the adjusting stem from rotating with respect to the sleeve.

* * * * *